United States Patent [19]

Gibson et al.

[11] 4,182,264

[45] Jan. 8, 1980

[54] APPARATUS FOR APPLYING A CREASE RETAINING COATING IN A PREFORMED CREASE

[75] Inventors: James D. M. Gibson, Ilkley; Kenneth Houlbrook, Dewsbury; John P. Coulter, Shipley, all of England

[73] Assignee: I.W.S. Nominee Company Limited, London, England

[21] Appl. No.: 906,973

[22] Filed: May 17, 1978

Related U.S. Application Data

[63] Continuation of Ser. No. 841,671, Oct. 13, 1977, abandoned.

[51] Int. Cl.[2] ..... B05C 5/00; B05C 13/02

[52] U.S. Cl. ..... 118/306; 401/147

[58] Field of Search ..... 118/207, 208, 305, 306, 118/307; 222/614, 613, 617, 618, 620, 623, 390; 401/172, 173, 174, 147, 150; 427/394 C

[56] References Cited

U.S. PATENT DOCUMENTS

| | | | |
|---|---|---|---|
| 1,383,379 | 7/1921 | Blain | 222/390 X |
| 1,471,330 | 10/1923 | Farmer | 222/390 |
| 2,176,891 | 10/1939 | Crom | 118/305 X |
| 2,504,787 | 4/1950 | Bailey | 222/623 X |
| 2,591,894 | 4/1952 | Voges | 222/620 X |
| 2,782,757 | 2/1957 | Carnes | 118/305 X |
| 2,819,822 | 1/1958 | Stokland | 222/620 X |
| 3,105,554 | 10/1963 | McCall | 118/306 X |
| 3,620,633 | 11/1971 | Charvoz | 401/147 |

FOREIGN PATENT DOCUMENTS

| | | | |
|---|---|---|---|
| 749638 | 5/1933 | France | 401/174 |
| 765461 | 3/1934 | France | 118/76 |
| 147388 | 8/1931 | Switzerland | 401/172 |

*Primary Examiner*—Morris Kaplan
*Attorney, Agent, or Firm*—Harold L. Stowell

[57] ABSTRACT

A durable crease is formed in a textile article by applying a flexible casting compound in a preformed crease using a non-rotary applicator in conjunction with a structure for guiding the applicator along the crease. A screw driven piston within the applicator dispenses the compound in response to applicator travel.

8 Claims, 10 Drawing Figures

APPARATUS FOR APPLYING A CREASE RETAINING COATING IN A PREFORMED CREASE

This is a continuation of application Ser. No. 841,671, filed Oct. 13, 1977, now abandoned.

CROSS REFERENCE TO RELATED APPLICATION

Related subject matter is disclosed and claimed in U.S. patent application Ser. No. 907,058, filed May 17, 1978, entitled, Apparatus for Creasing Textile Fabrics and Method, James Gibson et al.

BACKGROUND OF THE INVENTION

This invention relates to an apparatus for dispensing a crease setting composition and including means to guide the dispenser.

U.S. applications Ser. Nos. 664,898, filed Mar. 8, 1976 and 685,127, filed May 10, 1976, each now abandoned, disclose methods of forming a durable crease in a textile article in which a temporary crease is formed in the article, a rotary applicator is supplied with a liquid adhesive composition that sets to a solid insoluble in water and dry-cleaning solvents, and the applicator is guided along the temporary crease to deposit a line of the liquid composition in the apex of the crease before final hot pressing.

This process gives long-lasting creases stable to dry-cleaning, but under certain conditions of moisture and mechanical action the crease may become less well defined. Also, the requirement for a pre-pressing and a final pressing step does not always fit well into clothing production lines since additional steam presses may be needed.

BRIEF DESCRIPTION OF THE INVENTION

We have now discovered that by using certain casting compounds, preferably in conjunction with a non-rotary applicator, the final hot-pressing step can be omitted without adverse effect on the quality and durability of the crease, thus saving a processing step. Furthermore, the creases may be improved in durability, particularly under conditions of moisture and mechanical action.

According to the present invention there is provided an apparatus for forming a durable crease in a textile article which comprises forming a temporary crease of the desired sharpness in the article, and applying a flexible casting compound into the apex of the crease from an applicator guided along the crease whereby the shape of the crease is durably preserved when the casting compound has set.

Preferably the casting compound is a natural or synthetic material which sets or cures to a flexible, rubbery substance insoluble in water or dry-cleaning solvents. Advantageously, the amount of compound used is sufficient to fill the apex of the crease to a depth of from $\frac{1}{4}$ to 2 millimeters, preferably about 1 mm. Much more than this will produce creases the appearance of which resembles the sewn-in creases sometimes employed with jersey fabric trousers; much less and the 'casting' effect will be insufficient. The compound may be a curable latex or a curable thiol, polyurethane or silicone rubber, preferably the latter.

The silicone compositions which it is preferred to apply are those which cure to a soft, flexible, insoluble rubber-like material. Such compounds are commercially available for a number of end-uses, e.g., as caulking compounds. Particularly useful compounds are available under the tradenames Silastic RTU (Dow Corning) or Silcoset 151, 152 and 153 (ICI). The curing of such compounds is believed to be in the nature of a chemical cross-linking and is therefore irreversible.

The curing takes place at room temperature and it is preferred to keep the textile article folded flat along the crease line for the duration of the curing period.

It has been found that the amount of casting compound to be used is greater than the amount of adhesive used in the processes of our earlier applications, but the properties of the compound are such that durable and aesthetically pleasing creases can be obtained without a final pressing step.

In our earlier applications various types of rotary applicators are disclosed. We have found that the present invention is preferably carried into effect using an applicator which at the point of application of the compound to the textile is non-rotary, in order to deliver sufficient compound into the apex of the crease.

Accordingly, a further aspect of this invention now provides a fluid dispensing apparatus for applying fluid to a surface which comprises a fluid reservoir, a nozzle connected therewith, a rotatable member engageable with the surface and means responsive to rotation of the member for urging fluid from the reservoir through the nozzle.

The rotatable member preferably engages the textile article on either side of the crease line, whereby the nozzle may be guided in the apex of the preformed crease. To this end the nozzle is preferably of non-circular cross-section particularly towards it dispensing extremity, and may advantageously be formed as a slit. The speed of rotation of the member determines the rate of egress of fluid from the nozzle, and accordingly the amount of compound deposited in the crease (measured for example in g/m) is independent of the speed of passage of the apparatus along the crease.

In our U.S. applications there is disclosed a guiding system comprising a surface having a channel contoured to receive the crease of a pre-creased textile article whereby the article can be supported and contained in the area of the crease during application of adhesive. The process and apparatus of the present invention may be used with advantage with this guiding system.

The reservoir of the present dispenser is preferably a replaceable 'throw-away' cartridge and may conveniently be a moulded plastics material hypodermic syringe body. Such bodies are available commercially in large numbers and are therefore very inexpensive.

In this case the nozzle may be adapted from, or fitted to, the nozzle already formed in the syringe body.

The means responsive to rotation of the member preferably comprises a worm gear arrangement designed to urge a plunger into the reservoir as the member rotates. In order that the nozzle should not ooze fluid after use owing to excess pressure existing within the reservoir, means for retracting the plunger a small way may be provided which can be operated at the end of each run. Complementary means for inducing an initial pressure in the reservoir at the beginning of each run may also be provided.

While the dispensing apparatus of the invention will find its greatest use in performing the defined process, it is not so limited, and may be used for any purpose where it is desired to apply a line of fluid of controlled density.

A preferred aspect of the invention provides a stand carrying a spaced pair of elongate support arms or platforms, each arm being adapted to receive one leg or pair of trousers, and the arms optionally being rotatable as a pair through at least 180°.

The arms or platforms are conveniently adapted to receive a pre-creased pair of trousers turned inside-out and each preferably has a longitudinal channel or slot contoured to receive the crease and stabilizing the trousers so that the applicator can be run along the inner apex of the crease quickly and accurately. Advantageously, the underface of each of the arms or platforms also carries an equivalent slot or channel so that, on rotation through 180°, the underside creases of the trousers can be treated. The trousers are then turned right way out, and pressed to fix the crease.

Preferably the platforms are smooth to allow swift handling.

Thus the device of the invention enables very quick handling of each pair of trousers on equipment having a very low capital cost.

It will be appreciated that alghough the method is applicable to all textile articles, its principal use will be for permanently creasing trousers.

The textile articles to be durably creased may be in the form of garments, e.g., pleated skirts, or trousers. The fabrics or garments may be made of any fiber or blend of fibers, natural or synthetic, but it is envisaged that the process will be principally applicable to the non-heat-settable natural fibers, e.g., cellulosics and keratinous fibers, and especially wool. The fabrics or garments may be woven, knitted or non-woven. The invention is particularly useful with fabric constructions, e.g., knitted structures, in which it has hitherto been difficult to form a durable crease.

BRIEF DESCRIPTION OF THE DRAWINGS

The invention will be described further, by way of example only, with reference to the accompanying drawing, in which.

Figure 2:
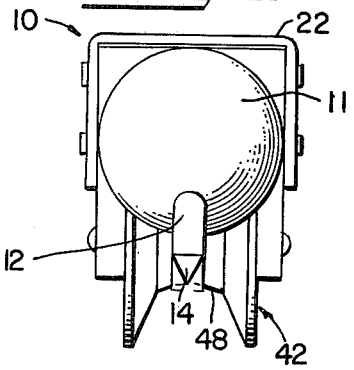
FIG. 2 is an end view of the dispensing apparatus taken in the direction II in FIG. 1.
Figure 3:
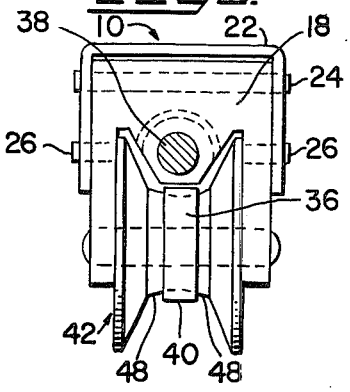
FIG. 3 is an end view of the dispensing apparatus taken in the direction III in FIG. 1.

As shown in the drawings, the dispensing apparatus 10 comprises a reservoir 11 in the form of a moulded plastics hypodermic syringe body having a nozzle 12. The nozzle 12 is threaded and screwed onto it is a fish-tail nozzle-end 14 which, as can be seen from FIG. 2, is flat and presents a slot-shaped exit for the contents of the reservoir 10. The reservoir 10 is push-fitted or screwed onto a shaped plastics block 16. A second plastics block 18 is a sliding fit in cylindrical recess in the block 16 and is biassed outwardly by a compression spring 20. A metal cover 22 pivotally attached to the block 16 by a pin 24 holds the second block 18 in place by trapping pegs 26 which extend from the second block 18, in recessed portions 28 of the cover 22. The shape of the recessed portions 28 is such that the pegs 26 will normally locate in their lowest corners unless the cover is pivoted downwardly, when the pegs will ride up the adjacent inclined surfaces 32 and urge the second block 18 farther into the recess in the block 16.

The second block 18 is formed with a recess 34 which carries an internally threaded and externally toothed gear wheel 36. A threaded rod 38 is engaged with the internal thread of the gear wheel 36, while the latter engages externally a worm drive 40 which forms part of a rotatable member 42 having two outer flanges 46 and two inner rubber surfaces 48. Thus when the member 42 is rotated the gear wheel 36 is rotated and the rod 38 moves axially, relative to the block 18.

At the extremity of the threaded rod 38, within the reservoir 10, is a tightly slidably fitted seal 50 carried on a former 52, designed to sweep the contents of the reservoir 10 towards the nozzle 12.

Figure 1:
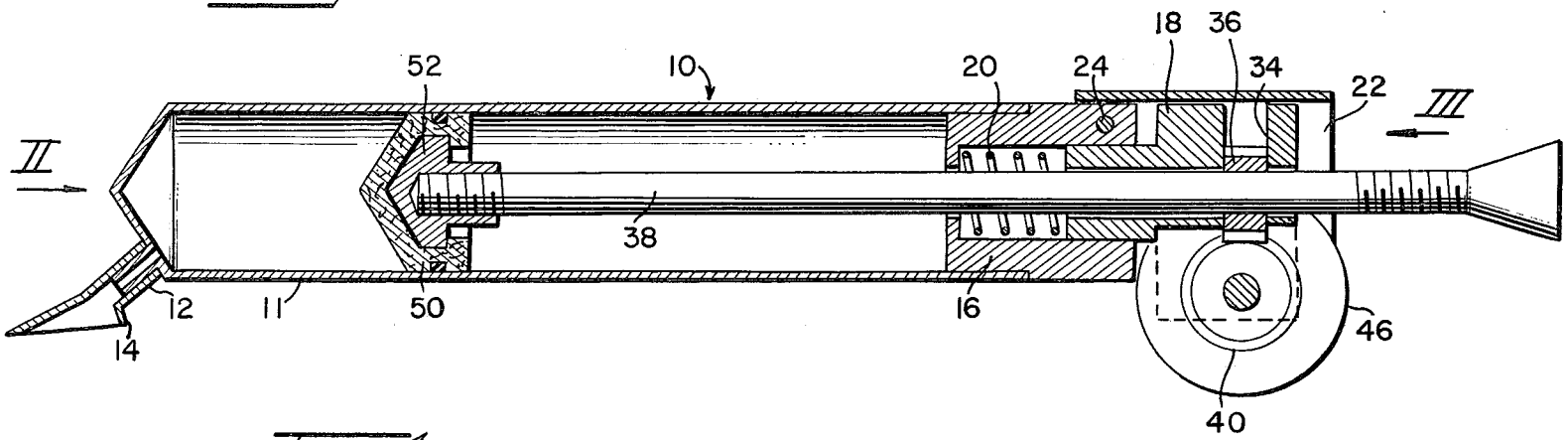
FIG. 1 is a longitudinal sectional view of a dispensing apparatus according to this invention.

In use the reservoir fluid 10 is filled with fluid, for example a curable silicone rubber compound, and the block 16 fitted thereto with the treaded rod and seal assembly screwed up close to the block. On engaging the rotatable member 42 with the surface to which the fluid is to be applied, the cover 22 is depressed into contact with the second block 18, forcing the peg 26 up the inclined surfaces 32 to the position shown in FIG. 1 and slightly pressurizing the fluid in the reservoir, so bringing it to the orifice of the nozzle. The nozzle is positioned as desired and the apparatus moved by rolling on the rotatable member 42, which revolves and thus drives the threaded rod 38 and the seal 50 through the reservoir, expressing fluid from the nozzle-end 14 in an amount proportional to the speed of rotation of the member 42. When the desired line of fluid has been laid the apparatus is lifted from the surface and the pressure on the cover 22 released. The spring acting through the second block 18 and pegs 26 forces the latter down the surfaces 32 to the lowest corners of the recesses 30, causing the rod 38 and seal 50 to withdraw slightly and depressurize the reservoir 10 and thereby preventing unwanted oozing of fluid from the nozzle end 14.

Figure 4:
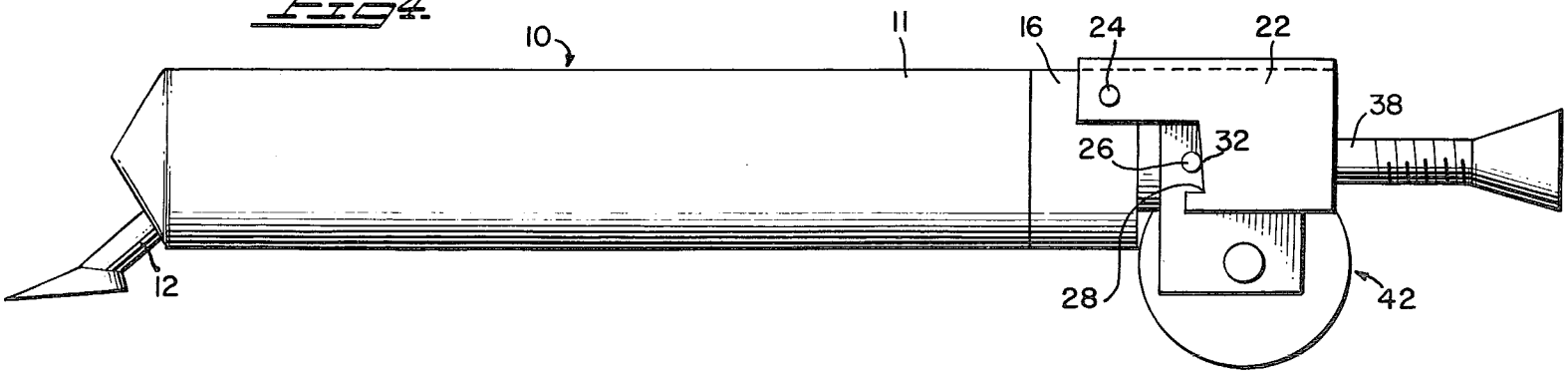
FIG. 4 is a view similar to FIG. 1 showing further details.

As shown in FIG. 4, a knurled knob 54 may be provided on the end of the rod 38 to assist the operative in pre-loading the plunger when a new adhesive cartridge (i.e., reservoir 10) is fitted to the operating mechanism.

Figure 5:
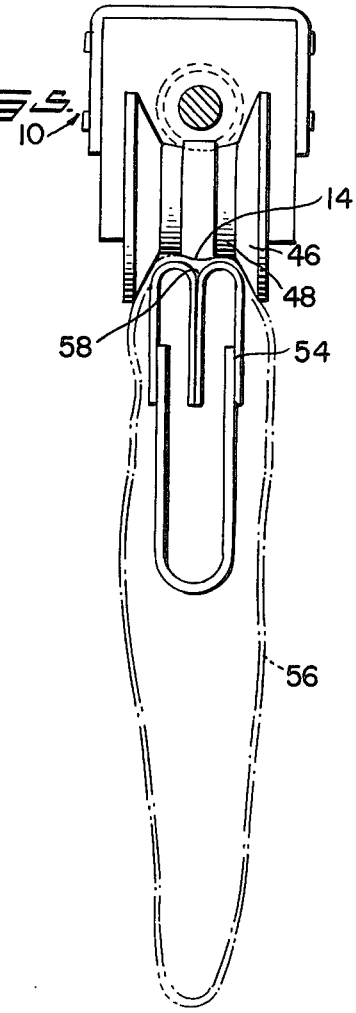
FIG. 5 is a cross-section through the dispensing apparatus.

The apparatus of the invention is particularly useful for performing the creasing process of the invention, especially in conjunction with the apparatus now to be described with which it is specifically designed to cooperate. FIG. 5 shows the combination in use, with a grooved support arm 54 supporting a trouser leg 56, turned inside out, which bears a temporary crease 58 and is engaged by the apparatus 10. The flanges 46 of the rotatable member 42 fit on either side of the upper part of the support arm 54, and the rubber surfaces 48 rest on the trouser fabric on either side of the crease line 58. The worm drive 40 is thus held clear of the fabric. The nozzle end 14 can be directed right into the apex of the crease to give a very accurate application of silicone compound to the pre-creased trousers, which are then removed from the arm 54, turned right way out, and laid flat to allow the compound to cure.

Trousers so treated have creases of good appearance, durable to wear, dry-cleaning and washing.

Figure 6:
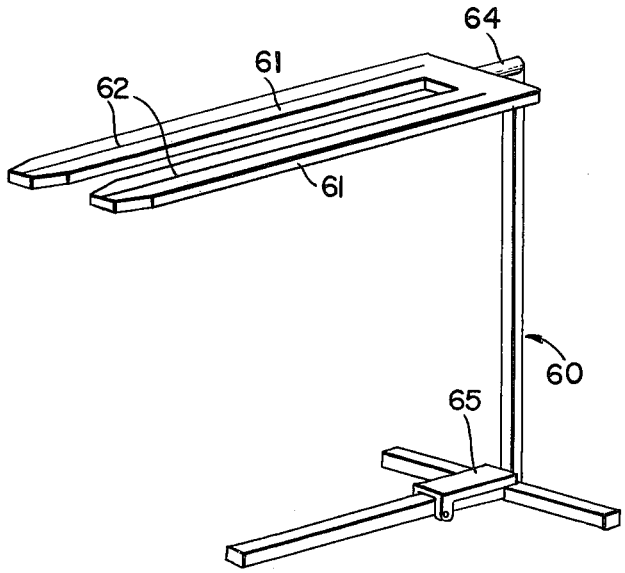
FIG. 6 is a perspective view of a stand for a textile article according to the invention.
Figure 7:
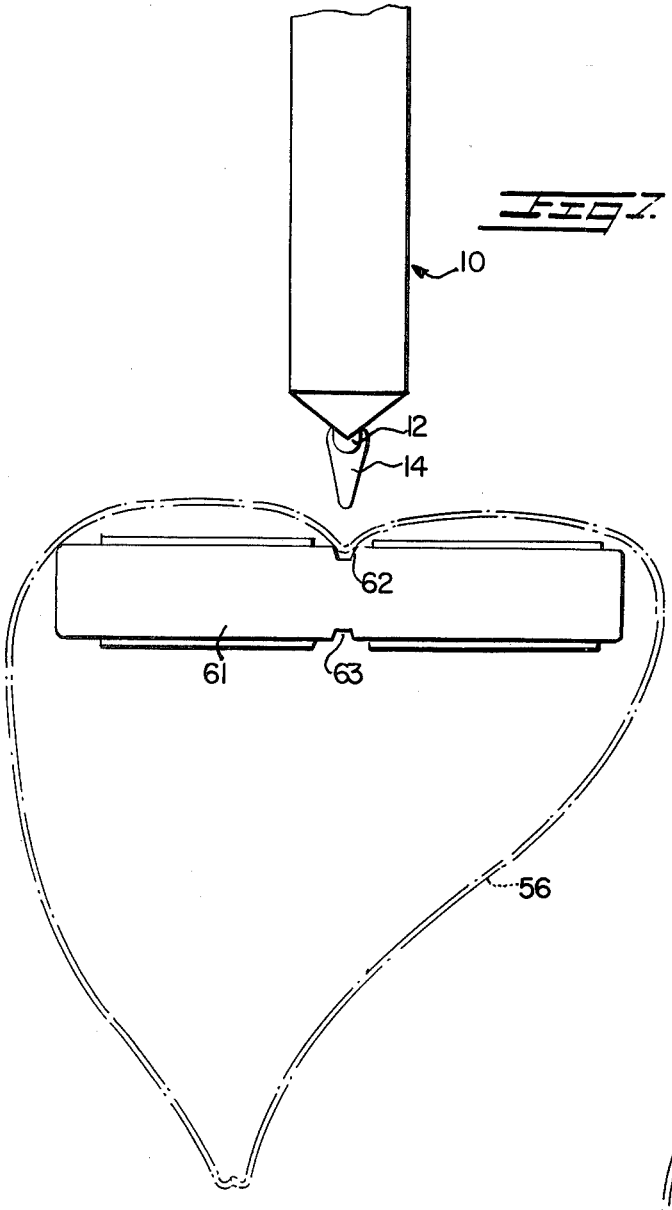
FIG. 7 is a fragmentary cross-section of the stand of FIG. 1 in combination with an adhesive applicator.

FIG. 6 shows a simple form of device according to this invention suitable for use in creasing trousers. An upright stand 60 carries a pair of elongate platforms 61 partly tapered at the tip, each being capable of receiving the leg of a pair of trousers. The platforms 61 each have in their surface a central channel or groove 62 adapted to receive a creased portion of a trouser leg. Similar channels 63 may be provided on the opposite faces of the platforms 61, as shown in FIG. 7. The same figure also shows a suitable applicator 10 in the operative position in relation to the channel 62. A trouser leg inside-out and in position for the application of adhesive by the applicator is shown in chain dotted lines at 56. In this position the adhesive applicator 10 can be run accurately along the inner apex of the crease. The platforms 61 may pivot at 64 through 180°, for example on operation of a foot pedal 65, in order that the underneath creases may be treated.

With the embodiment of FIGS. 6 and 7 it may be desirable to clamp or otherwise restrain the trouser legs alongside the grooves 62. For example a relatively heavy template or stencil may be placed over the trouser leg, or it may be physically clamped by conventional methods, e.g., means of load-spreading strips and G-clamps. An alternative method of temporarily restraining the trouser leg is to use light ferro-magnetic restraining plates in conjunction with magnets or electromagnets within the platforms 61 to clamp the trouser leg 56 by the force of magnetic attraction. Switching off the electromagnets enables the lightweight plates to be handled and positioned easily.

Figure 8:
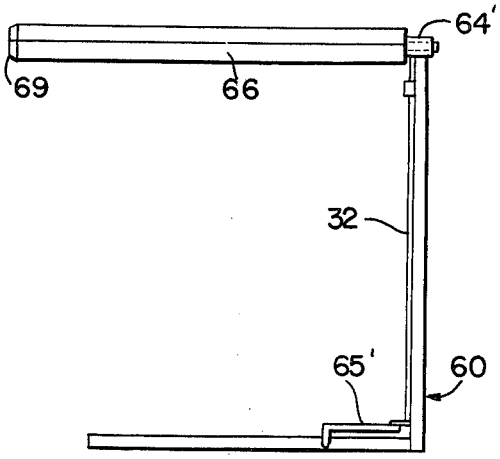
FIG. 8 is a side elevation of another and preferred form of stand.
Figure 9:
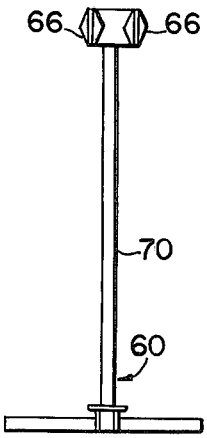
FIG. 9 is an end elevation of the stand of FIG. 3.
Figure 10:
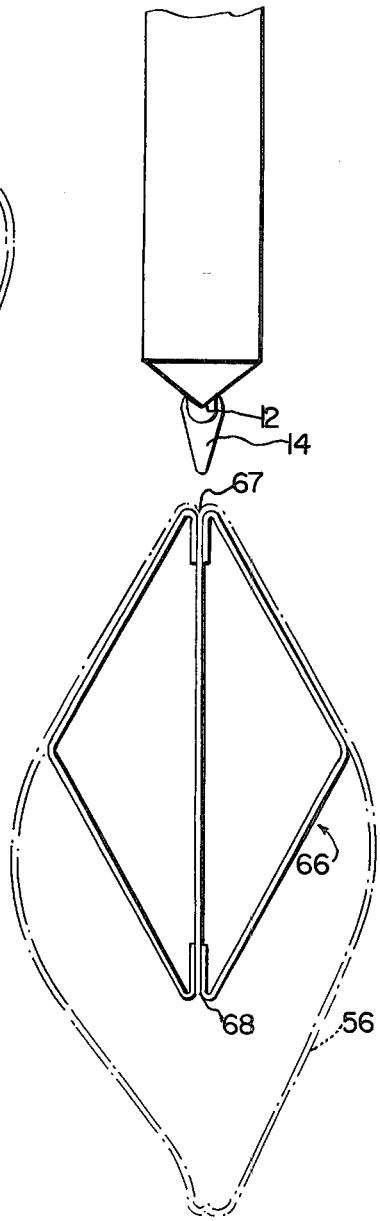
FIG. 10 is a cross-section similar to FIG. 7 but showing the stand of FIG. 8.

FIGS. 8, 9 and 10 illustrate a preferred form of device according to the invention with which external means of restraining the trouser legs is normally unnecessary. A stand 60 similar to that of FIG. 6 carries support arms 66 which are diamond shaped in cross-section and have channels 67 and 68 at their upper and lower apices. The free ends of the support arms 66 are tapered at 69 to facilitate the passage of trouser legs over them. The latter are indicated at 56 in position in FIG. 10, which also shows an applicator 10 in its operative position. The profile of these support arms is such that trouser legs 56 drape over them and the frictional contact between the material and the platform is sufficient to provide restraint and prevent the trouser legs rucking up during application of adhesive. The support arms can be rotated together through 180° about the mounting 64' by operation of foot pedal 65' through a push rod 70 to enable the lower creases on the trouser legs 56 to be brought to the top for engagement with the lower channels 68 without removing the trousers from the support arms 66.

What we claim is:

1. A fluid applicator for use in combination with a guide device comprising a syringe body reservoir; a nozzle for said reservoir; a fishtail end for said nozzle, a discharge slot in said end; a piston in said reservoir for forcing a fluid crease setting composition through said slot, and including a threaded piston rod; an externally toothed gear wheel operatively associated with and mounted on said threads; a drive worm supported by said body and engaging said gear wheel; a rotatable member connected to said drive worm and including spaced roller flanges and spaced rubber surfaces between and adjacent said flanges; a said guide device comprising an elongated structure adapted to accommodate a textile article having a preformed crease and said structure profiled to position said crease wherein to receive said fluid crease setting composition; said applicator being adapted to be mounted on said guide device with said roller flanges straddling said device whereby said applicator is guided during movement along said device, said rubber surfaces in contact with said positioned textile and said discharge slot disposed in operative association with said positioned crease; whereby an imparting motion to said fluid applicator to traverse along the elongated guide, rotary motion is transmitted to the worm which translates motion to the piston through said gear and piston rod, to effect said discharge of the fluid crease setting composition into the length of said preformed crease.

2. A fluid applicator as described in claim 1, said reservoir including an open end away from said nozzle, a removable plug closing said open end, said rod sliding in said plug, an axial bore in said plug, a closure for said bore, said rod sliding in said closure, and said rotatable member being rotatably mounted on said closure.

3. A fluid applicator as described in claim 2 including latch means pivotally mounted on said plug and engaging said closure.

4. Apparatus according to claim 1 wherein the nozzle terminates in a slot orientated in a direction transverse to that of the axis of rotation of the rotatable member.

5. Apparatus according to claim 1 wherein the reservoir is detachable from the nozzle and from the piston and body means mounting the drive means for said piston.

6. Apparatus according to claim 1 wherein the nozzle is detachable and the reservoir is a disposable container.

7. A fluid applicator for use in combination with a guide device; said applicator comprising a housing; guide engaging wheels at one end of the housing; a tubular reservoir for fluid to be dispensed supported by the housing; an outlet nozzle at the end of the reservoir remote from the guide engaging wheels; a piston in said reservoir; and means for causing said piston to move toward the outlet nozzle as the wheels of the applicator rotate in engagement with the guide device; said last named means including a threaded piston rod connected to said piston; a gear; internal threads on said gear in meshing engagement with the threads on said piston rod; external threads on said gear; a drive worm gear in mesh with the external threads on said gear; said worm gear connected to said guide engaging wheels whereby when the guide engaging wheels rotate on said guide device, fluid is positively dispensed from the nozzle in direct relation to the wheel rotation.

8. The invention defined in claim 7 wherein the wheels are provided with flanges and spaced rubber surfaces are provided between said flanges.

* * * * *

UNITED STATES PATENT AND TRADEMARK OFFICE

CERTIFICATE OF CORRECTION

PATENT NO. : 4,182,264

DATED : January 8, 1980

INVENTOR(S) : JAMES D.M. GIBSON; KENNETH HOULBROOK; JOHN P. COULTER

It is certified that error appears in the above-identified patent and that said Letters Patent are hereby corrected as shown below:

--[30] Foreign Application Priority Data

Feb. 21, 1977 United Kingdom .... 7229/77--

Signed and Sealed this

*Twenty-fifth* Day of *March 1980*

[SEAL]

*Attest:*

SIDNEY A. DIAMOND

*Attesting Officer*

*Commissioner of Patents and Trademarks*